US010213026B2

(12) United States Patent
Rohr

(10) Patent No.: US 10,213,026 B2
(45) Date of Patent: Feb. 26, 2019

(54) PULTRUDED ADJUSTABLE BED FRAME

(71) Applicant: L & P Property Management Company, South Gate, CA (US)

(72) Inventor: William R. Rohr, Joplin, MO (US)

(73) Assignee: L&P PROPERTY MANAGEMENT COMPANY, South Gate, GA (US)

( * ) Notice: Subject to any disclaimer, the term of this patent is extended or adjusted under 35 U.S.C. 154(b) by 345 days.

(21) Appl. No.: 14/833,806

(22) Filed: Aug. 24, 2015

(65) Prior Publication Data

US 2017/0055715 A1 Mar. 2, 2017

(51) Int. Cl.
*A47C 19/02* (2006.01)
*A47C 19/00* (2006.01)

(52) U.S. Cl.
CPC ..... *A47C 19/024* (2013.01); *A47C 19/005* (2013.01); *A47C 19/021* (2013.01); *A47C 19/02* (2013.01)

(58) Field of Classification Search
CPC ..... A47C 19/005; A47C 19/02; A47C 19/021; A47C 19/024
See application file for complete search history.

(56) References Cited

U.S. PATENT DOCUMENTS 603,814 A * 5/1898 Dipman ..... B62D 25/04 296/30
2,093,164 A * 9/1937 De Boer ..... A47C 19/021 5/131
4,016,612 A * 4/1977 Barile, Sr. ..... A47C 19/021 211/182
4,841,586 A * 6/1989 Juster ..... A47C 27/085 29/401.1
4,870,711 A * 10/1989 Felix ..... A47C 19/005 403/205
5,095,565 A * 3/1992 Brown ..... A47C 23/05 403/295
5,111,540 A * 5/1992 Caya ..... A47C 19/00 5/9.1
5,241,717 A * 9/1993 Ward ..... E04H 9/02 248/165
5,279,231 A * 1/1994 Kolvites ..... A47B 57/545 108/107
5,298,681 A * 3/1994 Swift ..... H02B 1/01 174/97
5,983,420 A * 11/1999 Tilley ..... A47B 13/02 108/91
8,136,180 B2 * 3/2012 Leng ..... A47C 21/08 5/282.1
8,584,277 B1 * 11/2013 Roberts ..... A47C 19/005 5/1
9,009,887 B2 * 4/2015 Lo ..... A47D 13/063 5/110
9,439,508 B2 * 9/2016 Wojtowicz ..... A47B 87/0215
(Continued)

*Primary Examiner* — Nicholas F Polito
*Assistant Examiner* — Ifeolu A Adeboyejo
(74) *Attorney, Agent, or Firm* — Shook, Hardy & Bacon L.L.P.

(57) ABSTRACT

Pultruded frames for an adjustable bed are described herein. The pultruded frames may include various components such as connection/joining and reinforcing structures. The various components and frame parts may be combined in multiple configurations to form light weight and strong adjustable bed frames.

13 Claims, 8 Drawing Sheets

(56) References Cited

U.S. PATENT DOCUMENTS

| | | | | |
|---|---|---|---|---|
| 2004/0199997 | A1* | 10/2004 | Harrow | A47C 19/005 5/201 |
| 2005/0273929 | A1* | 12/2005 | Hennings | A47C 19/00 5/201 |
| 2006/0112485 | A1* | 6/2006 | Harrow | A47C 19/005 5/201 |
| 2006/0195983 | A1* | 9/2006 | Polevoy | A47C 19/021 5/288 |
| 2007/0271869 | A1* | 11/2007 | Andrikanich | E04F 13/0864 52/656.1 |
| 2010/0293869 | A1* | 11/2010 | King | A47F 5/10 52/79.9 |
| 2011/0139738 | A1* | 6/2011 | Raybuck | B29C 66/52441 211/85.13 |
| 2011/0253659 | A1* | 10/2011 | Jarvis | A47B 47/045 211/153 |
| 2011/0272373 | A1* | 11/2011 | Wojtowicz | A47B 87/0215 |
| 2014/0117028 | A1* | 5/2014 | Huber | B65D 88/14 220/600 |
| 2014/0143953 | A1* | 5/2014 | Blair | A47C 4/022 5/285 |

* cited by examiner

PULTRUDED ADJUSTABLE BED FRAME

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

Embodiments of the present invention relate to a frame for an adjustable bed. More particularly, embodiments of the present invention relate to a pultruded frame for an adjustable bed.

BACKGROUND OF THE INVENTION

Current adjustable bed frames are typically constructed from numerous discrete steel or aluminum components. Because of the number of components, assembly of current adjustable bed frames is time-consuming and challenging. Additionally, because the traditional materials used in construction are heavy, shipping traditional adjustable bed frames is costly and inefficient.

BRIEF SUMMARY OF THE INVENTION

The invention is defined by the claims below. This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

Aspects of the present invention generally relate to an adjustable bed frame made primarily with pultruded components. Manufacturing the adjustable bed frame using pultruded components eliminates the need to mechanically or adhesively join the traditionally numerous components of an adjustable bed frame, because many of the pultruded components described herein may be integrally manufactured. As a result, the number of fabricated parts required for the adjustable bed frame is reduced. Thus, aspects herein reduce the number of fabricated components required for an adjustable bed frame and the need to mechanically or adhesively join all of the components, parts, and assemblies together.

Additionally, the pultruded adjustable bed components and assemblies described herein exhibit high strength, as pultrusions are typically stronger than structural steel on a pound-for-pound basis. Additionally, the pultruded adjustable bed components may be approximately 20-25% the weight of steel and 70% the weight of aluminum. The light weight of the pultruded adjustable bed components reduces transportation costs and allows for easier handling on a production line. The modular nature of the pultruded frames described herein provide for simplistic packaging and shipment of the adjustable bed frame and easy assembly in a retail location or consumer home.

Further, the pultrusions described herein have low thermal conductivity and may be electrically non-conductive. This is advantageous because many adjustable beds include various electrical components for operating the bed and controlling bed features. An adjustable bed frame that is electrically non-conductive reduces the risk of electrostatic discharge, which could damage a circuit board, or other electrical components, within the adjustable bed.

In some aspects, a pultruded adjustable bed frame may include a pair of spaced apart parallel opposed side rails and a pair of spaced apart parallel end rails. The end rails may be perpendicular to the parallel opposed side rails, and coupled to the parallel opposed side rails. The end rails may generally be coupled to the side rails at opposite ends of the adjustable bed frame using various connection structures. Consequently, the side rails and end rails may form a generally rectangular-shaped frame.

In other aspects, the pultruded frame for an adjustable bed may include the side rails and end rails mentioned above, and legs coupled thereto. In one aspect, each leg may have openings for receiving the side rails and the end rails. In this way, the side rails and the end rails may be coupled at the legs, with the legs being used to facilitate the coupling. Additionally, the side rails, the end rails, and the legs may be coupled using various connection structures.

In an additional aspect, the pultruded frame may include uprights. The uprights are configured for attachment between the side rails and end rails. Each of the uprights may be configured for attachment at a specific side of the bed. For example, there may be left-side uprights and right-side uprights. Further, the uprights may be configured to facilitate coupling the side rails and end rails. In other aspects, the various connection and reinforcing structures may be used to facilitate coupling of the pultruded adjustable bed components.

As mentioned above, various connectors and reinforcing structures may be used to facilitate coupling the portions of the frame to one another. For example, stamped metallic or fiberglass reinforced plastic (FRP) connection sleeves and reinforcing plates may be configured for attachment at various joints and connection points of the adjustable bed frame. The connectors and reinforcing structures may be affixed to the various frame rails and other frame parts as part of the manufacturing process. Additionally, in some aspects, the frame rails and other frame parts described herein may include the connectors and the reinforcing structures in an integrally manufactured component. For example, a frame rail may be manufactured from a unitary pultrusion material with connection sleeves at either end. Continuing with this example, a generally rectangular pultrusion material may be used for the frame rail, and the connection sleeves may be cut out or molded at either end of the frame rail. As can be appreciated, assembly of the aspects of the adjustable bed frame described herein is efficient, as there are relatively few fabrication steps and assembly steps.

Additional objects, advantages, and novel features of the invention will be set forth in part in the description that follows, and in part will become apparent to those skilled in the art upon examination of the following, or may be learned by practice of the invention.

BRIEF DESCRIPTION OF SEVERAL VIEWS OF THE DRAWINGS

The present invention is described in detail below with reference to the attached drawing figures, wherein.

DETAILED DESCRIPTION OF THE INVENTION

Figure 1:
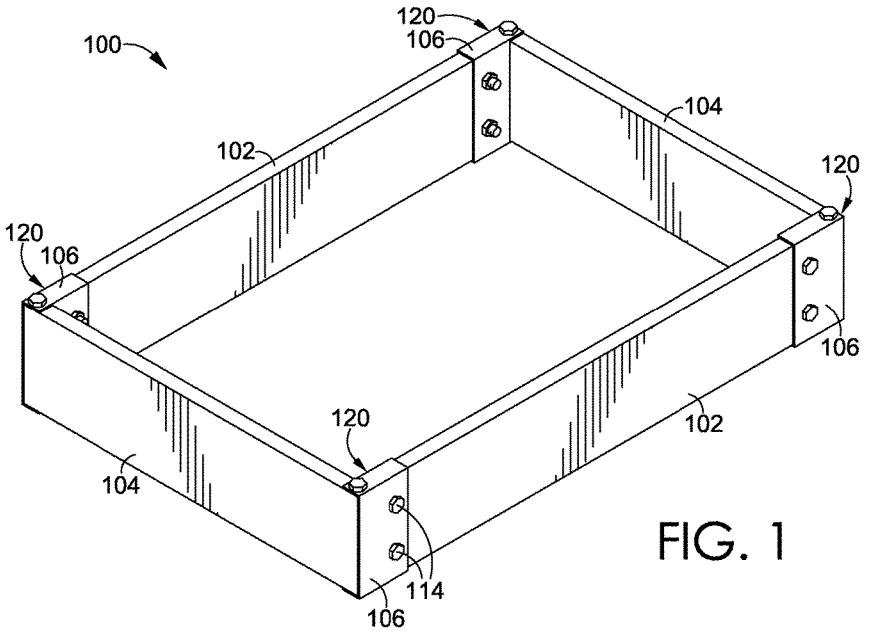
FIG. 1 is a perspective view of a pultruded frame for an adjustable bed having connection sleeves in an assembled configuration, in accordance with an aspect of the present invention.

The present invention generally relates to an adjustable bed frame made primarily with pultruded components. Accordingly, in one embodiment of the invention, an adjustable bed frame may comprise a pair of spaced apart parallel opposed side rails and a pair of spaced apart parallel end rails, which are perpendicular to and coupled to the side rails. In aspects herein, the rails and various other adjustable bed frame components may be manufactured using integrally formed pultruded structures including: tubes, beams (I beams, H beams, etc.), telescoping tubular shapes, flats, or C-channels with central web sections.

A pultrusion for making the rails and other pultruded components may include reels of unidirectional roving, which provide longitudinal tensile strength, and rolls of continuous filament mat, woven roving, and/or stitch fabric, that provide the pultruded components with transverse strength. The roving and or filaments may be pulled through a resin bath, which may include a polyester or vinyl ester, pigments, and various fillers to enhance desired properties and complete the pultrusion.

Further, the side rails and the end rails may be coupled, for example, using one or more connection and/or joining structures. The connection and/or joining structures may be constructed from a pultrusion, and/or may be compression and/or injected molded. This reduces the cost per piece and allows for the thickness and geometry to be optimized for function and cost. In other aspects, stamped metallic connection and/or joining members may be suitable in some applications.

Additionally, the rails of the adjustable bed frame may be manufactured such that they are integrally connected with the connection and/or joining parts. In one aspect, the connection and/or joining parts may be created separately from the rails and affixed to the rails as part of the manufacturing process. In another aspect, the rails may be manufactured with connection and/or joining parts at one or more ends of the rails. For example, a side rail may have a tubular construction, with connection sleeves disposed at one or more ends of the side rail. Continuing with this example, portions at an end of the tubular side rail may be cut, molded, or otherwise formed in the tubular side rail, such that the connection sleeves are a part of the tubular side rail. Apertures may also be formed in the tubular side rail by molding or drilling, such that the connection sleeves may receive a fastener. The fastener may be a nut/bolt, or other type of fastener, manufactured from FRP, plastic, steel, or other suitable material. Further, a tubular end rail may also have apertures corresponding to the apertures of the connection sleeves. As such, when the tubular side rail and the tubular end rail are joined, the fasteners pass through the apertures of the connection sleeves of the tubular side rail and the apertures of the tubular end rail, such that the fasteners may be secured, thereby forming a joint of the pultruded adjustable bed frame.

In additional aspects, the pultruded frame for an adjustable bed may include one or more legs. The legs may also be manufactured from a pultrusion similar to the pultrusion used for the rails. Additionally, the legs may be affixed to the connection and/or joining structures as part of the manufacturing process. Further, the legs may be configured to function as a connection and/or joining structure. For example, a leg may be manufactured with openings for receiving the side rails and the end rails. The legs may also have one or more apertures corresponding to apertures of the side rails and end rails for receiving fasteners.

In additional aspects, the pultruded frame for an adjustable bed may include one or more uprights. The uprights may be coupled between the side rails and the end rails. In this aspect, the end rails are coupled at a lower end of the uprights, such that the end rails are inferior to the side rails when the frame is assembled. The uprights, similar to the legs, may also be manufactured from a pultrusion and may have connection and/or joining structures affixed thereto as part of the manufacturing process. Additionally, the uprights may be manufactured such that the uprights function as the connection and/or joining structures.

FIG. 1 shows a pultruded frame 100 for an adjustable bed having side rails 102 and end rails 104, in an assembled configuration. In one aspect, the side rails 102 may comprise a pair of spaced apart parallel opposed side rails, and the end rails 104 may comprise a pair of spaced apart parallel end rails. Each of the end rails 104 may be perpendicular to and coupled to the side rails 102 at opposite ends of the side rails 102. The side rails 102 and the end rails 104 may be coupled, for example, using one or more connection sleeves 106 and one or more joints 120. The connection sleeves 106 may have one or more apertures (not shown in FIG. 1, but shown as apertures 108 in FIG. 2) for receiving one or more fasteners 114 to affix the side rails 102 and end rails 104 to the connection sleeves 106.

Figure 2:
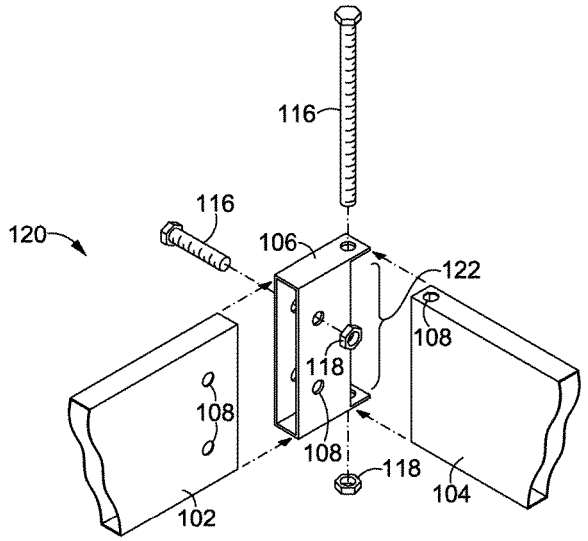
FIG. 2 is an exploded-isometric view of a joint of the pultruded frame according to FIG. 1, in accordance with an aspect of the present invention.

FIG. 2 illustrates an exemplary joint of the one or more joints 120 of the pultruded frame 100 according to FIG. 1 having an exemplary connection sleeve of the connection sleeves 106. As shown in FIG. 2, each of the connection sleeves 106 may be configured to fit around (or within, not shown) the side rails 102 and each of joints 120. Each of the connection sleeves 106 may have a cutout 122 for receiving the end rails 104. The connection sleeves 106, side rails 102, and end rails 104 may have one or more apertures 108 for receiving fasteners 114. The fasteners 114 may comprise, for example, one or more bolts 116 and one or more nuts 118. Each of connection sleeves 106 may be constructed, for example, from a pultrusion similar to the pultrusion used for the side rails 102 and the end rails 104. The cutout 122 and apertures 108 of each of the connection sleeves 106 may be added after manufacturing, or may be molded into each of the connection sleeves 106 during the manufacturing of each of the connection sleeves 106. In some aspects, each of the connection sleeves 106 may be adhesively affixed to one of the side rails 102 and the end rails 104 during manufacturing, such that the apertures 108 and fasteners 114 are not required. It should be appreciated that the connection sleeves 106, and other structures described herein for coupling the side rails 102 to the end rails 104, are generally located at terminal ends of the side rails 102 and end rails 104.

Figure 3:
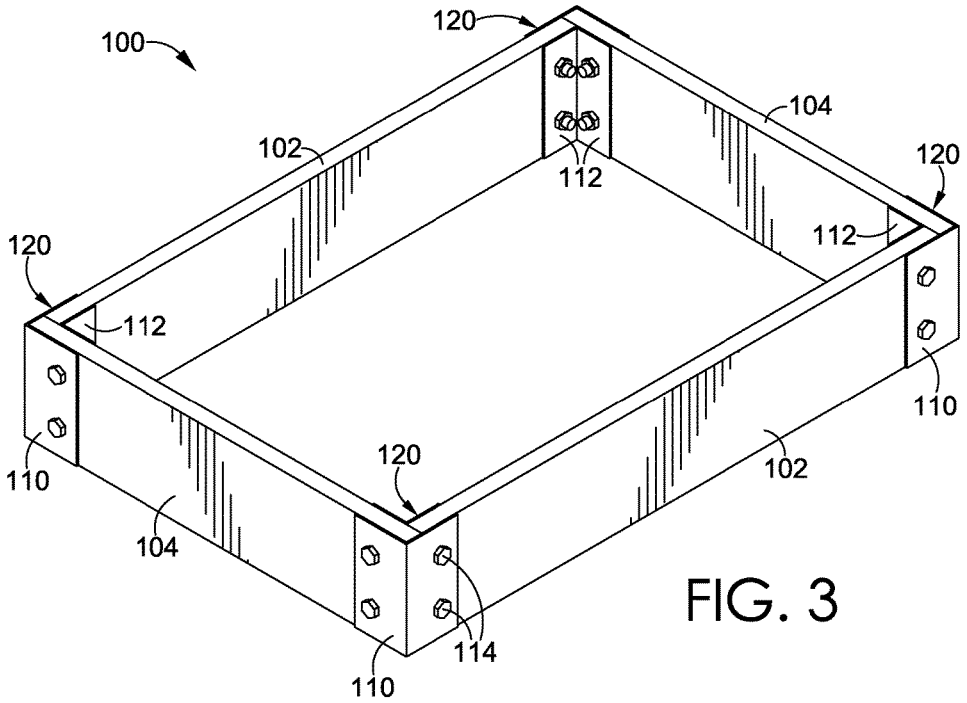
FIG. 3 is a perspective view of a pultruded frame for an adjustable bed having L-brackets and reinforcing plates in an assembled configuration, in accordance with an aspect of the present invention.
Figure 4:
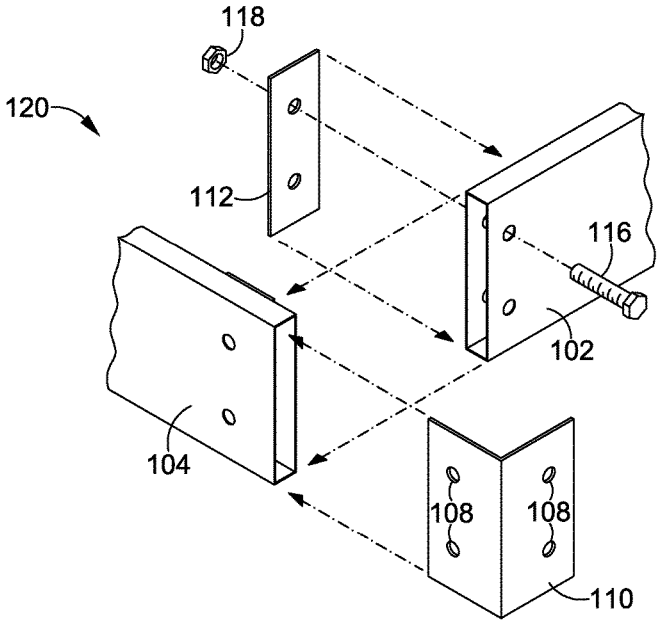
FIG. 4 is an exploded-isometric view of a joint of the pultruded frame according to FIG. 3, in accordance with an aspect of the present invention.
Figure 5:
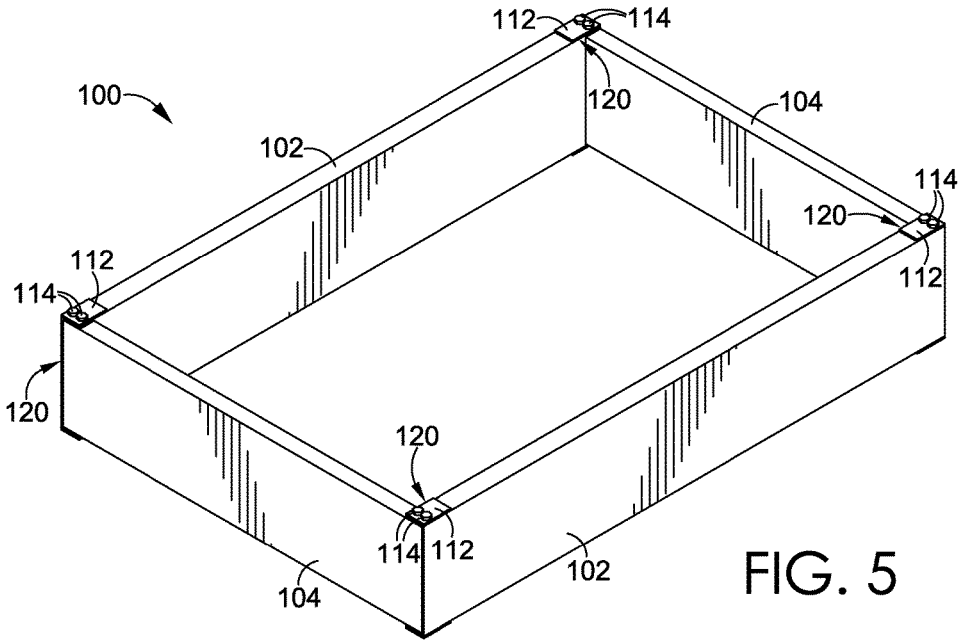
FIG. 5 is a perspective view of a pultruded frame for an adjustable bed with side rails having cutouts for receiving end rails in an assembled configuration, in accordance with an aspect of the present invention.

FIGS. 3 and 5 show additional aspects of a pultruded frame 100 for an adjustable bed. In some aspects, as shown in FIG. 3, one or more L-brackets 110 may be affixed the end rails 104 or side rails 102. The pultruded frame 100 may additionally have one or more joints 120 and one or more reinforcing plates 112, opposite the L-brackets 110, for reinforcing the joints 120. Accordingly, in some aspects, each of the joints 120 may have two reinforcing plates 112 opposite the L-brackets 110 for reinforcing the joints 120. FIG. 5 illustrates another aspect of the pultruded frame 100, wherein each of the end rails 104 has been inserted into rail cutouts (not shown in FIG. 5 but shown as rail cutouts 124 in FIG. 6) at each end of the side rails 102. The L-brackets 110, reinforcing plates 112, side rails 102, and end rails 104 may have one or more apertures (not shown in FIGS. 3 and 5, but shown as apertures 108 in FIGS. 4 and 6) for receiving fasteners 114 to affix the side rails 102 to the end rails 104.

Figure 6:
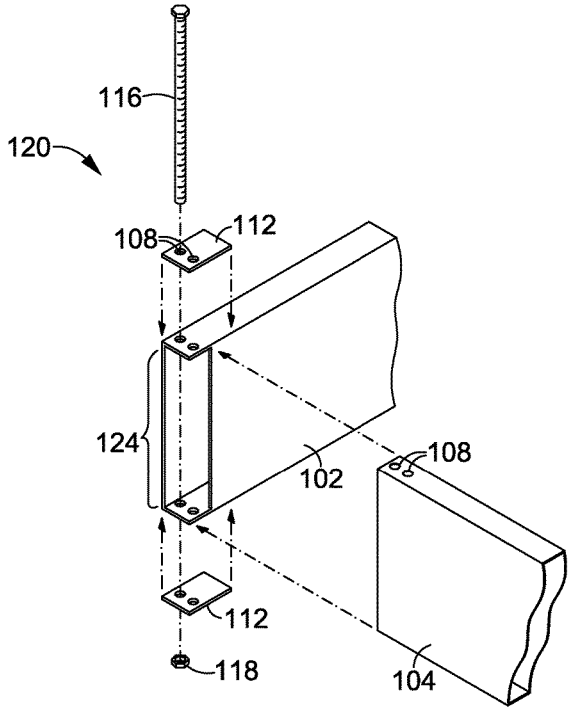
FIG. 6 is an exploded-isometric view of a joint of the pultruded frame according to FIG. 5, in accordance with an aspect of the present invention.

FIGS. 4 and 6 illustrate exemplary joints of the one or more joints 120 of the pultruded frame 100 according to FIGS. 3 and 5. FIG. 4 illustrates a joint 120 having an exemplary reinforcing plate of the one or more reinforcing plates 112 and an exemplary L-bracket of the one or more L-brackets 110. Each of the reinforcing plates 112 may be combined with each of the L-brackets 110, or other suitable brackets, to couple the side rails 102 to the end rails 104. Each of the L-brackets 110 and each of reinforcing plates 112 may be adhesively, or otherwise, affixed to the side rails 102 and/or the end rails 104 as part of the manufacturing process. As such, each of the L-brackets 110 and each of the reinforcing plates 112 may be affixed to the side rails 102 and end rails 104 pre-assembled, such that an assembler does not have to affix them during assembly of the pultruded frame 100. It should be appreciated that although shown in one way in the figures, each of the L-brackets 110 and each of the reinforcing plates 112 may be affixed either to the side rails 102 or to the end rails 104. FIG. 6 illustrates that side rails 102 may be manufactured with one or more rail cutouts 124. In this aspect, side rails 102 may have the rail cutouts 124 for receiving the end rails 104. In some aspects, the end rails 104 may be slightly smaller than the side rails 102, such that the end rails 104 may be inserted into rail cutouts 124 and coupled to the side rails 102. In some aspects, the side rails 102 may have the reinforcing plates 112 affixed thereto for reinforcing the joints 120. In an alternative aspect, the end rails 104 may be manufactured with the rail cutouts 124, such that the end rails 104 may receive the side rails 102. One or more apertures 108 may be configured to receive one or more fasteners 114 for affixing the side rails 102 to end rails 104. The fasteners 114 may comprise, for example, bolts 116 and nuts 118.

Figure 7:
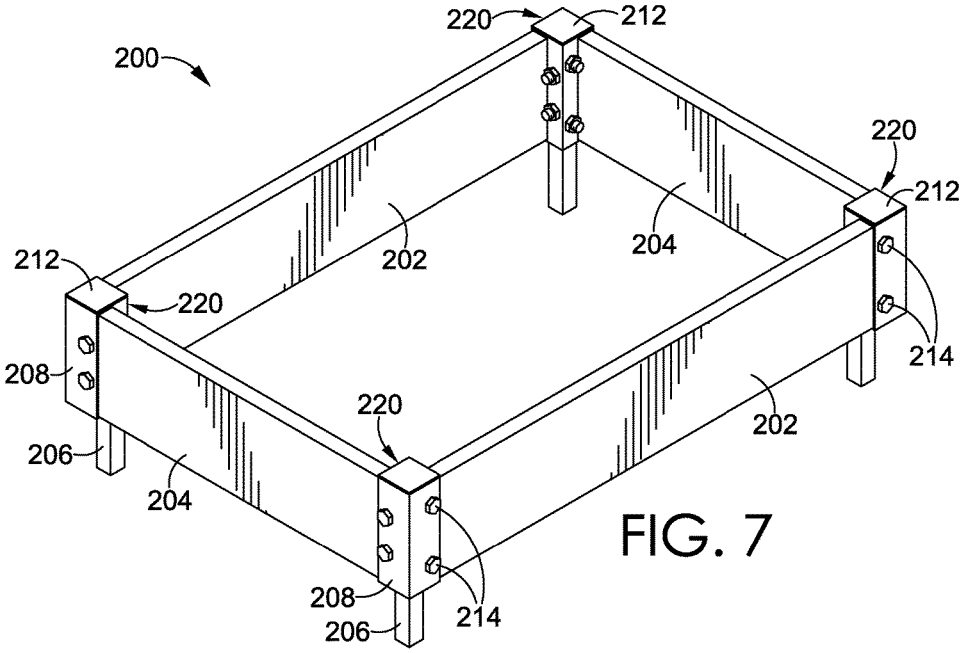
FIG. 7 is a perspective view of a pultruded frame for an adjustable bed having side rails, end rails, and legs in an assembled configuration, in accordance with an aspect of the present invention.

FIG. 7 illustrates another aspect of a pultruded frame 200 for an adjustable bed having side rails 202, end rails 204, and legs 206, in an assembled configuration. In one aspect, the side rails 202 may comprise a pair of spaced apart parallel opposed side rails, and the end rails 204 may comprise a pair of spaced apart parallel end rails. Each of the end rails 204 may be perpendicular to and coupled to the side rails 202 at opposite ends of the side rails 202. In some aspects, the side rails 202, end rails 204, and legs 206 are coupled at one or more joints 220. The legs 206 may have a length that is longer than a width of the side rails 202 and the end rails 204, such that the legs 206 extend downwardly beyond the side rails 202 and end rails 204 when the pultruded frame 200 is in an assembled configuration. One or more connection sleeves 208 may be located at each of the joints 220 for coupling the side rails 202, the end rails 204, and the legs 206. The connection sleeves 208 may have one or more apertures (not shown in FIG. 7, but shown as apertures 210 in FIG. 8) corresponding to apertures on each of the side rails 202 and end rails 204 for receiving fasteners 214. The connection sleeves 208 may additionally have a top plate 212 affixed thereto, such that the connection sleeves 208 do not slide downward when coupled at joints 220.

Figure 8:
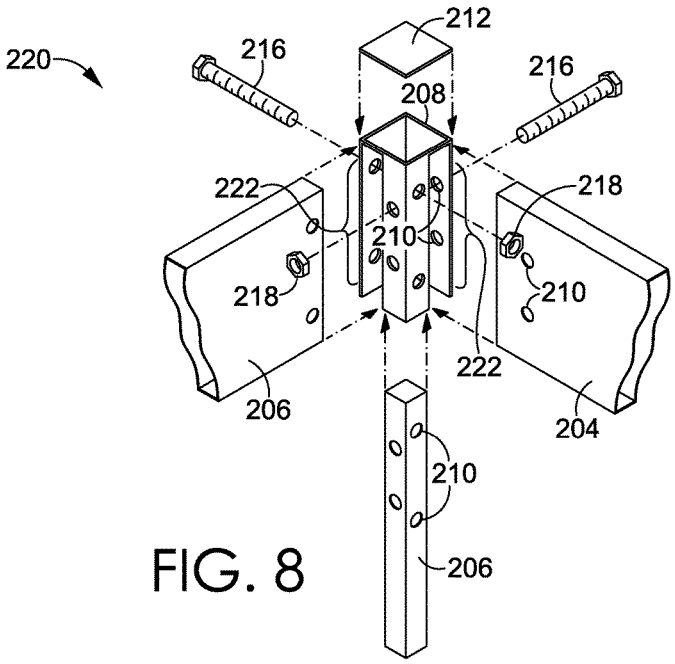
FIG. 8 is an exploded-isometric view of a joint of the pultruded frame according to FIG. 7 having connection sleeves, in accordance with an aspect of the present invention.

FIG. 8 illustrates an exemplary joint of the one or more joints 220 of the pultruded frame 200 according to FIG. 7 with an exemplary connection sleeve of the one or more connection sleeves 208. Although only one of each of the components of the pultruded frame 200 is shown in FIG. 7, the components will be referred to in a plural context, because each of the components has the same structure. In one aspect, the connection sleeves 208 may be manufactured from a generally rectangular or square pultrusion. The connection sleeves 208 may have one or more cutouts 222 for receiving the side rails 202 and the end rails 204. The connection sleeves 208 may additionally have a top plate 212 and one or more apertures 210, corresponding to the apertures 210 on each of the side rails 202, the end rails 204, and the legs 206. As such, the side rails 202 and end rails 204 may be inserted into the cutouts 222 of the connection sleeves 208. Fasteners 214 may then be inserted through apertures 210 to affix the connection sleeves 208 to the side rails 202, the end rails 204, and the legs 206. The fasteners 214 may comprise, for example, bolts 216 and nuts 218.

In other aspects, the connection sleeves 208 may be affixed to the legs 206, the side rails 202, and/or the end rails 204 as part of the manufacturing process. In this aspect, the connection sleeves 208 may be adhesively, or otherwise, affixed to the other frame parts prior to assembly, such that fewer fasteners 214 are required for assembly. For example, the connection sleeves 208 may be affixed to the end rails 204 as part of the manufacturing process. As such, only the side rails 202 and legs 206 may need to be inserted into and affixed connection sleeves 208 to complete assembly of the pultruded frame 200. As can be appreciated, the legs 206 may also be affixed to the connection sleeves 208 and/or the end rails 204 as part of manufacturing process, such that only the side rails 202 need to be inserted into and affixed to the connection sleeves 208 to complete assembly of the pultruded frame 200.

Figure 10:
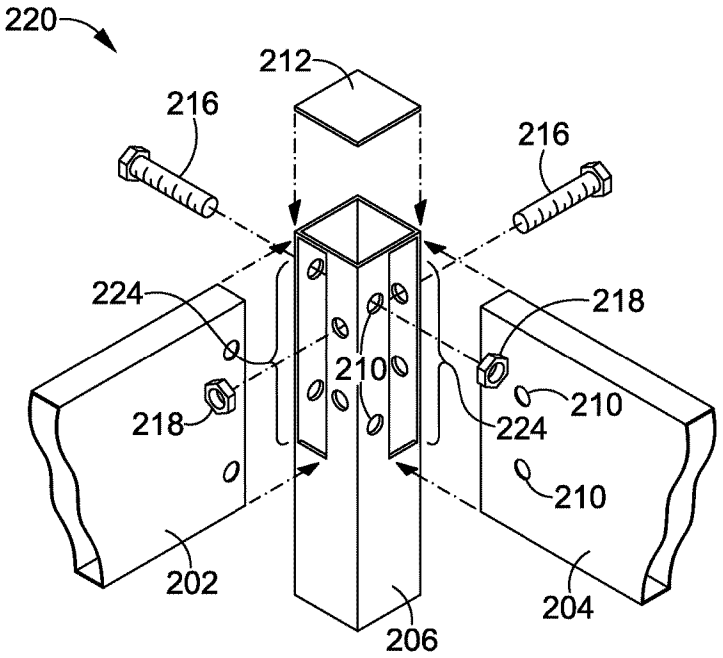
FIG. 10 is an exploded-isometric view of a joint of the pultruded frame according to FIG. 7 having legs that are configured for receiving the side rails and the end rails, in accordance with an aspect of the present invention.
Figure 9:
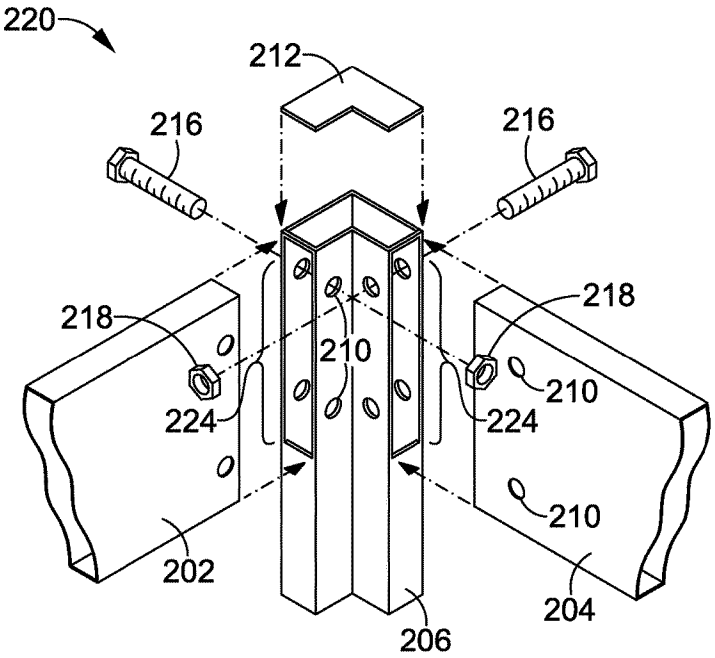
FIG. 9 is an exploded-isometric view of a joint of the pultruded frame according to FIG. 7 having legs that are configured for receiving the side rails and the end rails, in accordance with an aspect of the present invention.

FIG. 9 illustrates another aspect of the legs 206 of the pultruded frame 200 according to FIG. 7. In this aspect, the legs 206 are configured to facilitate coupling the side rails 202 and the end rails 204. Said another way, the legs 206 are manufactured such that they function as a connection sleeve at a joint of the one or more joints 220 of the pultruded frame 200. As such, the pultruded frame 200 may comprise side rails 202, end rails 204, and legs 206, without connection sleeves. In some aspects, the legs 206 may be formed from a right angled dihedral protrusion, such that an interior surface of the legs 206 is immediately adjacent to the side rails 202 and the end rails 204 when the pultruded frame is assembled. Alternatively, as shown in FIG. 10, the legs 206 may be formed from a generally rectangular or square pultruded tube. Further, legs 206 may have openings 224 for receiving the side rails 202 and the end rails 204. A top plate 212 may be affixed to each of the legs 206, rather than the connection sleeves as shown in FIG. 8. As such, each of the joints 220 is formed by the legs 206, the side rails 202, and the end rails 204. Accordingly, in this aspect, the pultruded frame 200 may be assembled without the connection sleeves 208. The legs 206 may have one or more apertures 210, corresponding to the apertures 210 on each of the side rails 202 and the end rails 204. As such, the side rails 202 and end rails 204 may be inserted into the openings 224 of the legs 206. Fasteners 214 may then be inserted through apertures 210 to secure the legs 206 to the side rails 202 and the end rails 204. The fasteners 214 may comprise, for example, bolts 216 and nuts 218.

Figure 11:
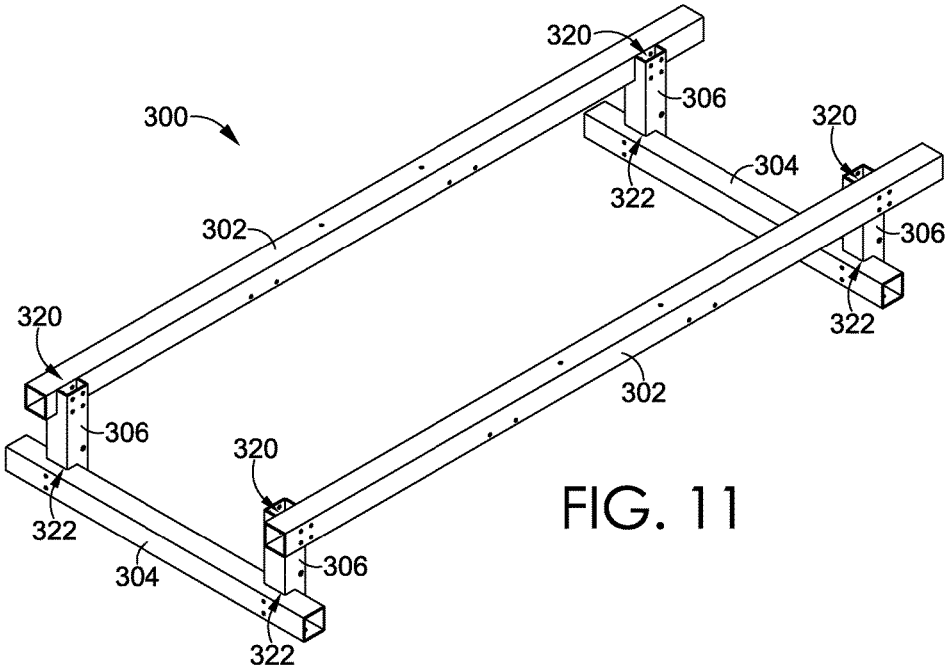
FIG. 11 is a perspective view of a pultruded frame for an adjustable bed in an assembled configuration, in accordance with an aspect of the present invention.

FIG. 11 illustrates another aspect of a pultruded frame 300 for an adjustable bed having side rails 302, end rails 304, and uprights 306, in an assembled configuration. In this aspect, the side rails 302 may comprise a pair of spaced apart, parallel opposed side rails and the end rails 304 may comprise a pair of spaced apart, parallel opposed end rails 304. The uprights 306 may be coupled between the side rails 302 and end rails 304. The end rails 304 may be coupled to the uprights 306 such that the end rails 304 are perpendicular to the side rails 302. The side rails 302, the end rails 304, and the uprights 306 may be coupled at one or more joints 320. Further, the end rails 304 are disposed at a bottom portion of the pultruded frame 300 when the frame is assembled and ready for use.

Figure 12:
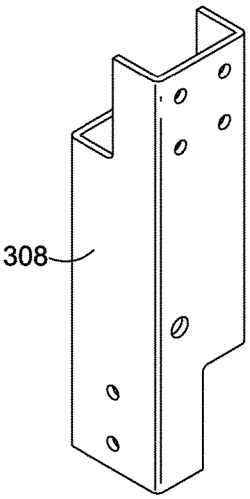
FIG. 12 is an isometric view of a first-side upright of the pultruded frame according to FIG. 11, in accordance with an aspect of the present invention.
Figure 13:
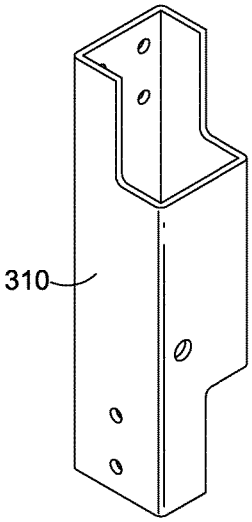
FIG. 13 is an isometric view of a second-side upright of the pultruded frame according to FIG. 11, in accordance with an aspect of the present invention.

FIGS. 12 and 13 illustrate one aspect of the uprights 306 according to FIG. 11. In some aspects, the uprights 306 may be side specific. For example, the uprights 306 may include a pair of right-side uprights and a pair of left-side uprights. A right-side upright 308 is shown in FIG. 12 and a left-side upright 310 is shown in FIG. 13. In this aspect, each right-side upright 308 will be coupled to a first side rail of side rails 302. Although the side-specific uprights are referred to as right-side and left-side uprights, it should be appreciated that the side-specific uprights could be alternatively described. For example, the side-specific uprights could be referred to as a pair of first-side uprights and a pair of second-side uprights.

Figure 14:
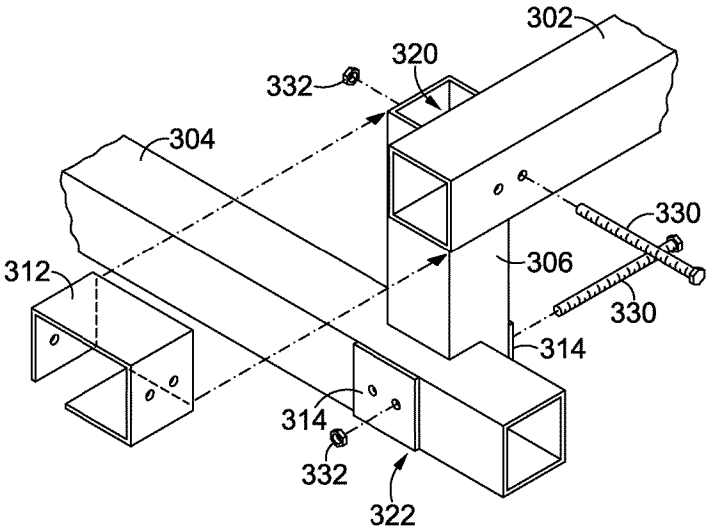
FIG. 14 is an exploded-isometric view of an alternate joint of the pultruded frame for use generally according to FIG. 11 having C-brackets and reinforcing plates, in accordance with an aspect of the present invention.

FIG. 14 depicts an exemplary joint of the one or more joints 320 of the pultruded frame 300 according to FIG. 11. In some aspects, the uprights 306 may be coupled to the side rails 302 with one or more C-brackets 312. Further, the uprights 306 may be coupled to the end rails 304 with one or more reinforcing plates 314. As can be appreciated, other connection shapes, brackets, and plates may be used to couple the various frame components at the joints 320. As described hereinabove with reference to the other aspects of pultruded frames, the C-brackets 312 and reinforcing plates 314 may be coupled to the side rails 302 and end rails 304 using bolts 330 and nuts 332.

Figure 15:
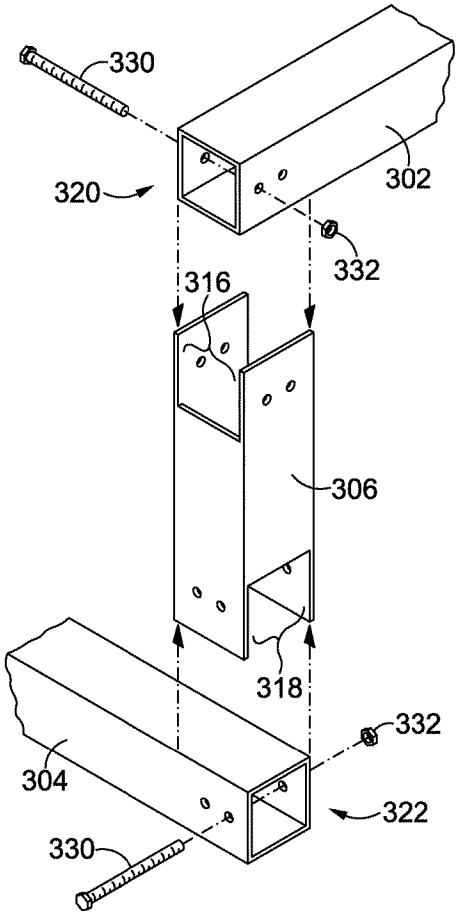
FIG. 15 is an exploded-isometric view of an alternate joint of the pultruded frame for use generally according to FIG. 11 having uprights with connection sleeves, in accordance with an aspect of the present invention.

FIG. 15 depicts an additional aspect of a joint of the one or more joints 320 of the pultruded frame 300 according to FIG. 11. As illustrated in FIG. 15, in some aspects, the uprights 306 may have one or more cutouts or openings, for example, a first cutout 316 and a second cutout 318 (the one or more cutouts or openings may also be described as cavities). The first cutout 316 and the second cutout 318 may be located at opposite ends of the uprights 306. Further, the first cutout 316 and the second cutout 318 may face in opposite directions, such that the first cutout 316 may receive the side rails 302 and the second cutout 318 may receive the end rails 304. As a result, the uprights 306 may function as a connection means for coupling the side rails 302 to the end rails 304. In an alternative aspect, the side rails 302 and/or the end rails 304 may have one or more cutouts at opposite ends of the rails for receiving the uprights 306. As will be appreciated, the frame components described herein may have varying sizes, such that the components may receive one or more other components.

Figure 16:
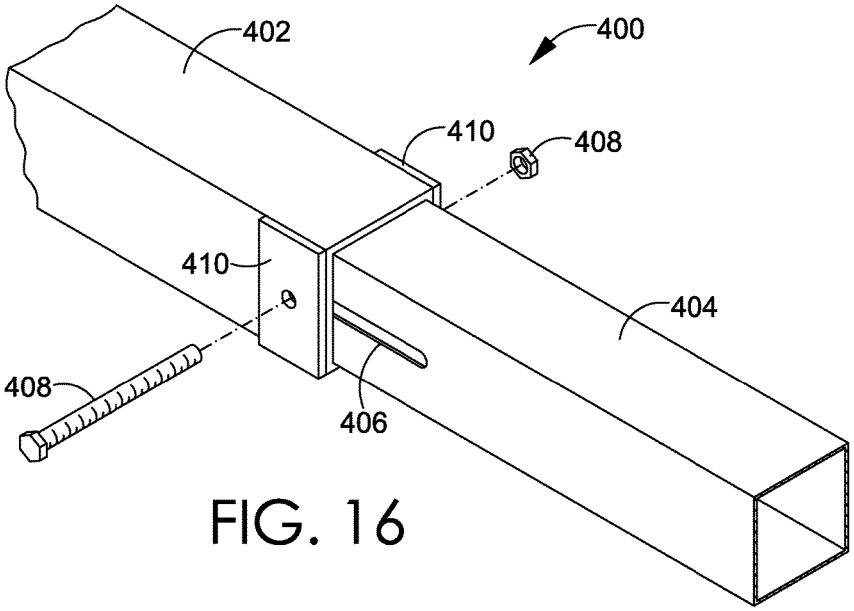
FIG. 16 is a perspective view of an adjustable rail of a pultruded adjustable bed frame, in accordance with an aspect of the present invention.

In some aspects, the various rails described herein may be adjustable in length. For example, as shown in FIG. 16, an adjustable rail 400 may comprise a first tube 402 and a second tube 404. The first tube 402 may be manufactured such that it may receive the second tube 404. The second tube 404 may have one or more channels 406 for receiving one or more fasteners 408, which pass through one or more apertures (not shown) in the first tube 402. As such, the adjustable rail 400 may be adjusted in a telescopic manner and retained at the desired length by tightening fasteners 408. Additionally, the first tube 402 may have one or more reinforcing plates 410 for reinforcing the adjustable rail 400 against force created by fasteners 408.

Figure 17:
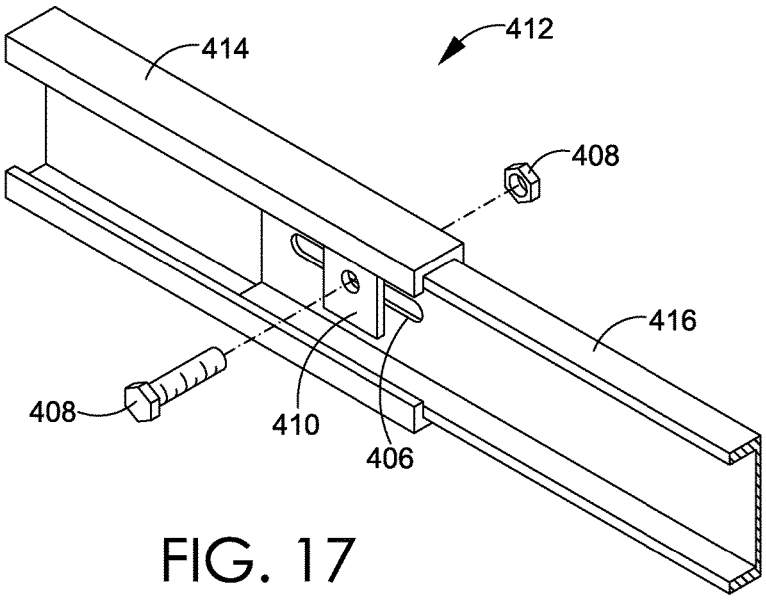
FIG. 17 is a perspective view of a C-channel adjustable rail of a pultruded adjustable bed frame, in accordance with an aspect of the present invention.

In additional aspects, an adjustable rail may be formed from one or more C-channel or U-channel pultrusions. For example, as shown in FIG. 17, a C-channel adjustable rail 412 may have a first C-channel part 414 for receiving a second C-channel part 416. Similar to the adjustable rail 400 described hereinabove, the second C-channel part 416 may have one or more channels 406 for receiving one or more fasteners 408, which pass through one or more apertures (not shown) in the first C-channel part 414. As such, the C-channel adjustable rail 412 may be adjusted in a telescopic manner and retained at the desired length by tightening fasteners 408. In some aspects, the second C-channel part 416 and the first C-channel part 414 may have one or more reinforcing plates 410 for reinforcing the C-channel adjustable rail 412 against force created by fasteners 408.

FIGS. 18-21 illustrate various joining, connection and reinforcing structures. Although shown as one part, a plurality of the joining, connection and reinforcing structures shown in FIGS. 18-21 may be used in a pultruded frame for an adjustable bed. FIG. 18 shows a reinforcing plate 500. In the various aspects herein, the reinforcing plate 500 may be manufactured from FRP or steel. The reinforcing plate 500 may be used in multiple ways to facilitate coupling of the various pultruded frame components described hereinabove. For example, reinforcing plates may be affixed at opposing sides at the end of one or more rails, such that a U-shaped connection sleeve is formed by the reinforcing plates. Similar to the aspects described hereinabove, the reinforcing plate 500 may have apertures therein for receiving fasteners.

Referring now generally to each of the aspects described hereinabove, the pultruded components for the adjustable bed frames may be made from a fiber-reinforced composite. In a non-limiting example, the pultrusions may include a fibrous reinforcing materials such as glass (E-glass, S-glass), aramid, polymeric, or carbon (carbon/graphite) fibers that have been embedded in a resin matrix. The resin matrix (thermoset) may include a polymer, an unsaturated polyester, phenolic or epoxy vinyl ester, or cyanates. The fibrous reinforcing material may include numerous fibers or filaments and one or more mats (roving, mat, fabric) or webs of fibrous materials. Conductive pultrusions can be produced which contain fine conductive elements of ferrous dust, shavings, metal wires, or conductive rovings. These conductive terrific elements contained in pultruded components (resin bath) can then be electrostatically color coated.

The various aspects described herein may also be configured to function with a capacitance detector. For example, one or more segments of capacitive wiring may be included in or added to a pultruded frame and coupled to a capacitance detector for an adjustable bed.

Additionally, the various adjustable bed frame components described hereinabove may be pigmented throughout a thickness of the component and can be made to virtually any desired custom color. Special surfacing veils are also available to create special surface appearances such as wood grain, marble, and granite. Additionally, the pultrusions used herein may be preconditioned such that they are well suited for receiving surface paints.

From the foregoing, it will be seen that this invention is one well adapted to attain all the ends and objects hereinabove set forth together with other advantages, which are obvious and which are inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

What is claimed:

1. A frame for a bed, comprising:

a pair of side rails, each end of each side rail comprising a side-rail aperture;

a pair of end rails, each end of each end rail comprising an end-rail aperture;

a plurality of legs, each leg comprising a first-leg aperture and a second-leg aperture, the first-leg aperture and second-leg aperture located on adjoining sides of the leg; and a plurality of connection sleeves, each one of the plurality of connection sleeves comprising:

a first side comprising a first-side aperture, a second side comprising a second-side aperture, the second side adjoining the first side to form a right angle, a third side comprising a third-side aperture, the third side spaced from the first side such that a first elongated slot is formed between the first side and the third side, and a fourth side comprising a fourth-side aperture, the fourth side adjoining the third side to form a right angle, the fourth side spaced from the second side such that a second elongated slot is formed between the second side and the fourth side, wherein the right angle formed by the first and second sides faces towards the right angle formed by the third and fourth sides, wherein the first, second, third, and fourth sides are coupled together, wherein the first elongated slot is sized to receive an end of one of the side rails such that the side rail aperture thereof is alignable with the first-side aperture, the fourth-side aperture, and the first-leg aperture of one of the legs, and wherein the second elongated slot is sized to receive an end of one of the end rails such that the end rail aperture thereof is alignable with the second-side aperture, the third-side aperture, and the second-leg aperture of the one of the legs.

2. The frame for an adjustable bed of claim 1, wherein at least one of the pair of end rails, the pair of side rails, the plurality legs, or the plurality of connection sleeves is a pultruded component.

3. The frame for an adjustable bed of claim 1, wherein the pair of spaced apart parallel opposed end rails are configured to be adjusted in length.

4. The frame of claim 1, wherein the first-leg aperture and the second-leg aperture of each leg are offset from each ether along an axis extending between a first end and a second end of the leg.

5. The frame of claim 1, wherein, for each connection sleeve, the first-side aperture and the second-side aperture are offset from each other along an axis extending between a first end and a second end of the connection sleeve, and the third-side aperture and the fourth-side aperture are offset from each other along the axis extending between the first end and the second end of the connection sleeve.

6. The frame of claim 1, further comprising a first fastener and a second fastener, wherein the first fastener is sized to be received through the aligned first-side aperture, fourth-side aperture, and first-leg aperture, and wherein the second fastener is sized to be received through the aligned second-side aperture, third-side aperture, and second-leg aperture.

7. The frame of claim 1, wherein the first-side aperture comprises a pair of first-side apertures, wherein the second-side aperture comprises a pair of second-side apertures, and wherein the pair of second-side apertures are closer to each other than the pair of first-side apertures.

8. The frame of claim 1, wherein the third-side aperture comprises a pair of third-side apertures, wherein the fourth side aperture comprises a pair of fourth-side apertures, and wherein the pair of third-side apertures are closer to each other than the pair of fourth-side apertures.

9. The frame of claim 1, wherein each leg of the plurality of legs is sized such that it can be received within one of the plurality of connection sleeves adjacent the third and fourth sides thereof.

10. The frame of claim 1, wherein the plurality of connection sleeves and the plurality of legs each comprise a square cross-section.

11. The frame of claim 1, further comprising a plurality of top plates each securable to a first end of the connection sleeves.

12. The frame of claim 1, wherein the first side and the third side are spaced apart by the first elongated slot a same distance as the second side and the fourth side are spaced apart by the second elongated slot.

13. A connection sleeve for a frame of a bed, comprising:

a first side comprising a first-side aperture;

a second side comprising a second-side aperture, the second side adjoining the first side to form a right angle;

a third side comprising a third-side aperture that is alignable with a first-leg aperture of a leg, the third side spaced from the first side such that a first elongated slot is formed between the first side and the third side; and a fourth side comprising a fourth-side aperture that is alignable with a second-lee aperture of the leg, the fourth side adjoining the third side to form a right angle, the fourth side spaced from the second side such that a second elongated slot is formed between the second side and the fourth side, wherein the right angle formed by the first and second sides faces towards the right angle formed by the third and fourth sides, wherein the first, second, third, and fourth sides are coupled together, wherein the first elongated slot is sized to receive an end of a side rail such that a side rail aperture thereof is alignable with the first-side aperture, the fourth-side aperture of the connection sleeve, and the second-leg aperture of the leg, and wherein the second elongated slot is sized to receive an end of an end rail such that an end rail aperture thereof is alignable with the second-side aperture, the third-side aperture of the connection sleeve, and the first-leg aperture of the leg.

* * * * *